United States Patent [19]

Burke et al.

[11] Patent Number: 4,726,193

[45] Date of Patent: Feb. 23, 1988

[54] TEMPERATURE CONTROLLED PICNIC BOX

[76] Inventors: Edward J. Burke, 1700 Hearthstone, Plano, Tex. 75023; Gregory J. Nancarrow, 117 Foster La., Wylie, Tex. 75098

[21] Appl. No.: 14,360

[22] Filed: Feb. 13, 1987

[51] Int. Cl.[4] ..... F25B 21/02

[52] U.S. Cl. ..... 62/3; 62/449; 62/457

[58] Field of Search ..... 62/457, 3, 449

[56] References Cited

U.S. PATENT DOCUMENTS

| | | | |
|---|---|---|---|
| 2,094,542 | 9/1937 | Kuhnel | 62/449 |
| 2,671,603 | 3/1954 | Bauer | 62/449 X |
| 3,078,682 | 2/1963 | Gould | 62/3 |
| 3,194,023 | 7/1965 | Sudmeier | 62/522 X |
| 3,821,881 | 7/1974 | Harkias | 62/3 |
| 3,823,567 | 7/1974 | Corini | 62/3 |
| 4,364,234 | 12/1982 | Reed | 62/3 |

*Primary Examiner*—Lloyd L. King
*Attorney, Agent, or Firm*—A. H. Bandy

[57] ABSTRACT

A refrigerator/food warmer includes an insulated food compartment and lid. A thermoelectric heat exchanger and air circulator are mounted in the lid with both a heatsink of the thermoelectric heat exchanger and an air impeller of the air circulator above and below the lid, respectively. The air impeller above the lid draws air through the corresponding heat sink for improving the temperature differential between opposing sides of the thermoelectric heat exchanger, and the air impeller below the lid forces air of the insulated housing through the corresponding heat sink for conditioning the air hot or cold, as desired, and circulating the conditioned air throughout the insulated housing.

3 Claims, 3 Drawing Figures

TEMPERATURE CONTROLLED PICNIC BOX

BACKGROUND OF THE INVENTION

This invention relates to picnic boxes and more particularly to a refrigerator/warmer type box apparatus.

Portable refrigerator/food warmers which operate in cars, trucks, planes, boats, golf carts, and recreational vehicles operating on 12 volt dc systems are known. They are also used with optional 110 volt or 220 volt ac/12 volt dc power adaptor in offices, hotels, dormitories, and cabins.

A known "conduction" type refrigerator/food warmer includes a compartmentalized box having an open top with a hinged lid for closing the top opening. The compartmentalized box has a food compartment and an adjacent thermal heat pump compartment. The food compartment is separated from the thermal heat pump by a metal wall. The metal wall acts as a cold/hot conductive plate for a thermal heat pump for cooling or heating the food compartment. The thermal heat pump polarization is switchable to either cool or heat the metal partition as desired.

This "conduction" type refrigerator/food warmer has a cooling or heating problem resulting from the use of the metal partition as cold/hot plate. The cold/hot plate problem stems from the temperature gradient formed outwardly of the edges of the plate portion to which the thermal heat pump is attached. More importantly the air temperature with the compartment exhibits a large temperature gradient. This temperature gradient is significant enough to cause food spoilage.

An example of the above described device, is the Electric (AC/DC) Portable Refrigerator/Food Warmer, model HN-10 sold by Hsin Nan Enterprise Co. Ltd., Taipei, Taiwan.

While the purpose of the present invention is that of the known devices, the essential difference is that the present invention provides a "convection" type refrigerator/food warmer.

SUMMARY OF THE INVENTION

Accordingly, it is an object of the present invention to provide an improved refrigerator/food warmer box.

Another object of the invention is to provide a convection type refrigerator/food warmer box.

Still another object of the invention is to provide a refrigerator/food warmer box which selectively cools or heats air and circulates cold air or hot air, respectively, throughout the food compartment.

A further object of the invention is to maximize the volume of the refrigerator/food warmer food compartment.

Briefly stated the refrigerator/food warmer box of the present invention includes a thermoelectric system operatively attached to the box, said thermoelectric system including an air circulator and a thermoelectric heat exchanger, the air circulator for selectively drawing air from the ambient into and exhausting the hot/-cold air from the thermoelectric heat exchanger for improving its operating efficiency, and the thermoelectric heat exchanger coacting with the air circulator for conditioning selectively by cooling and heating the air in the box and circulating the conditioned air throughout the box interior.

BRIEF DESCRIPTION OF THE DRAWINGS

Other objects and features of the invention will become more readily understood from the following detailed description and appended claims when read in conjunction with the accompanying drawings in which:

DETAILED DECRIPTION OF A PREFERRED EMBODIMENT

Figure 1:
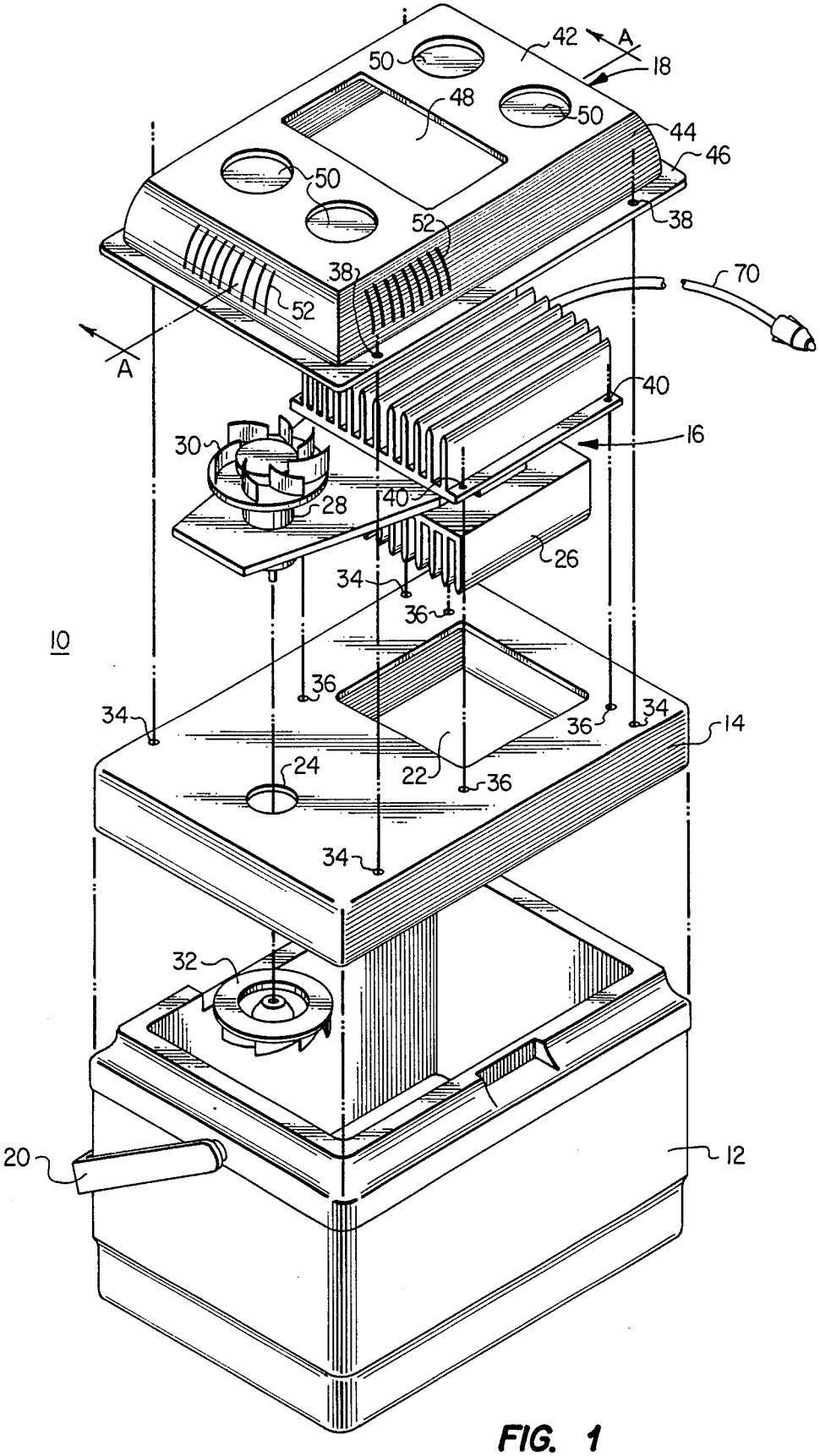
FIG. 1 is an exploded isometric view of the refrigerator/food warmer box constituting the invention.

The refrigerator/food warmer box 10 (FIG. 1) constituting the subject matter of the invention includes a housing 12 having insulated walls forming a food compartment with an open top, an apertured lid 14 for enclosing the food compartment opened top, an air conditioner means including a thermoelectric system 16 connected to the lid 14 by suitable fasteners, and an apertured shroud 18 connected to the lid 14 for protectively enclosing and directing air to the thermoelectric system 16. A box carrying handle 20 is attached to the food compartment housing 12 to facilitate portage. The housing 12 and lid 14 are suitably insulated or fabricated of an insulating material for isolating the food compartment from the environment.

The apertured lid 14 includes walls forming apertures 22 and 24, respectively, for receiving an array of thermoelectric elements 60 and heat sink 26 of a thermoelectric heat exchanger 54 and drive motor 28 for air impellers 30 and 32 of an air circulating unit 56 of the thermoelectric system 16, hereinafter more fully described in connection with FIGS. 2 and 3. The lid 14 is a thermally insulated lid which also includes, for example, a plurality of threaded apertures 34 and 36 corresponding, respectively, to shroud apertures 38 and refrigerator/food warmer, air circulating unit apertures 40 for threadedly receiving connecting bolts (not shown) to connect the shroud 18 and unit 16 to the lid.

The shroud 18 includes a top surface 42 with sides 44 depending to a flange 46. The top surface has walls forming a storage tray aperture 48 centrally disposed with respect to a plurality of beverage cup receiving recesses 50. The side walls 44 include a plurality of air entry and exhaust vents 52 positioned adjacent to the outside impeller 30.

Figure 2:
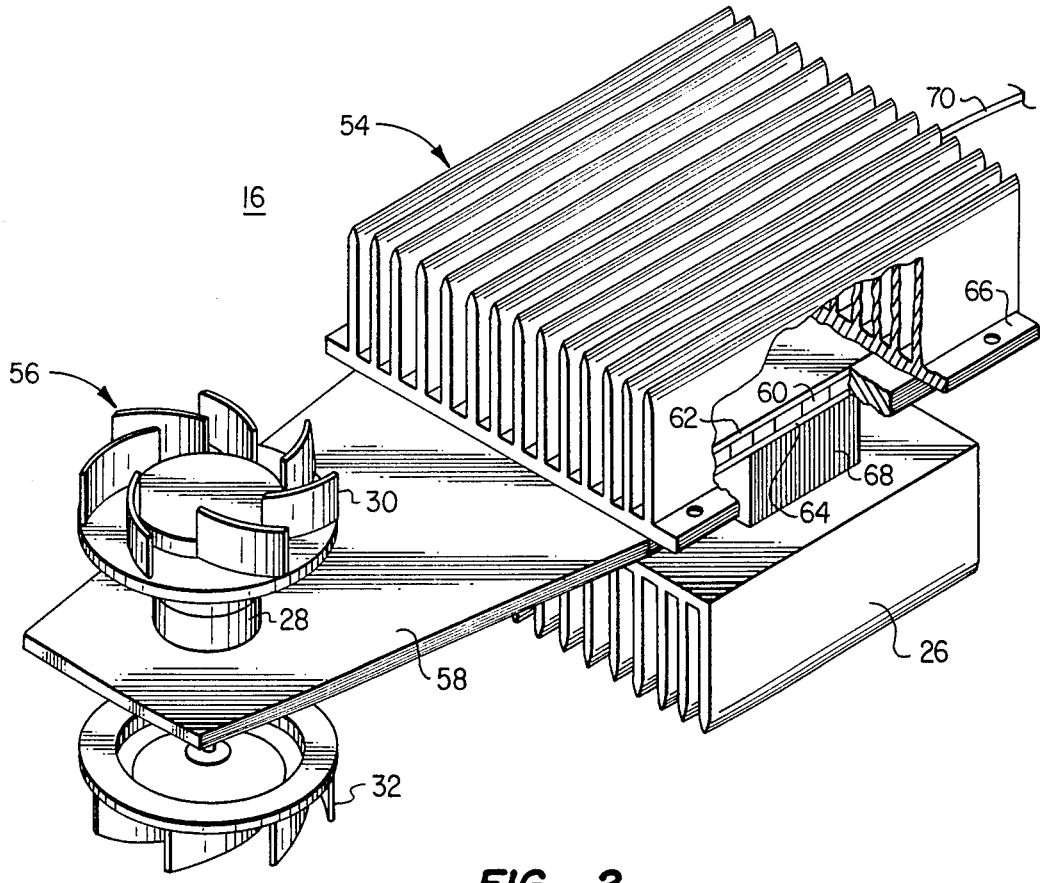
FIG. 2 is an isometric view of the refrigerator/food warmer, air circulator device removed from the box of FIG. 1.

Referring now to FIG. 2, the thermoelectric system 16 includes the thermoelectric heat exchanger 54 and the air circulator unit 56 connected to an apertured plate 58. The apertures of plate 58 correspond to the lids apertures 22 and 24. The thermoelectric heat exchanger 54 includes an array 60 of p-n junction type thermoelectric elements sandwiched between plates 62 and 64. A finned plate 66 is connected to plate 62 and a conductive block 68 has a first surface connected to plate 64 and a second surface connected to finned plate 26. Plates 62 and 64 are generally called hot and cold plates and the finned plates 66 and 26 are generally called heat sinks although their respective roles are reversed for cooling and warming operations.

The air circulating unit 56 includes the outside and inside impellers 30 and 32 connected to the drive shafts of common drive motor 28.

Figure 3:
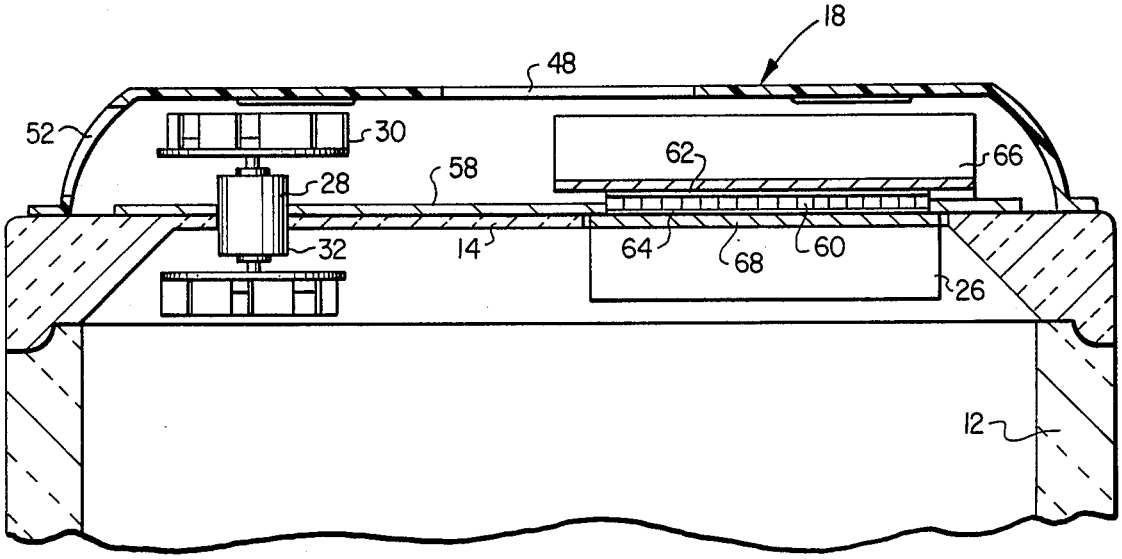
FIG. 3 is a fragmented cross sectional view of the refrigerator/food warmer box taken along line A—A of FIG. 1.

Referring now to FIG. 3, the array 60 of p-n junction type thermoelectric elements is mounted in the plate 58 and lid aperture 22 with finned plate (heat sink) 66 extending upwardly into the shroud 18 and the finned plate (heat sink) 26 extending inwardly of the lid 14. A conductor 70 connects a dc source to the thermoelectric elements 60 with the positive and negative poles connected to the p and n terminals, respectively, for cooling and polarity reversal for heating.

The common drive motor 28 is mounted in the apertured plate 58 and lid aperture 24 with the outside air impeller extending upwardly into the shroud 18 adjacent to the vents 52 and the inside air impeller depending into the lid.

In operation food or beverages or both are placed into the housing food compartment 12 and the lid 14 positioned in the housing opening. The unit is then connected using conductor 70 to a 12 V dc power source. The unit is then selectively turned on for either a cooling or warming operation of the thermoelectric heat exchanger and for starting the air circulating unit motor. In the cooling operation, ambient air is drawn into the shroud 18, through the heatsink 66 and exhausted through the vents 52 by the impeller 30 for improving the operating efficiency of the thermoelectric heat exchanger. While, air in the food compartment is circulated through the cooling finned plate (heatsink) 26 and randomly circulated throughout the housing food compartment 12 by the inside impeller 32 for cooling the food. It will be appreciated by those skilled in the art that the unit efficiency is improved by the improved temperature difference between the hot and cold plates of the thermoelectric heat exchanger resulting by passing air through the heatsinks. In the warming operation the polarity of the current is reversed to reverse the roles of the thermoelectric heat exchanger elements to heat the food and exhaust cold air from the shroud.

Although only a single embodiment of the invention has been described, it will be appreciated by those skilled in the art that various modifications to the details of construction shown and described may be made without departing from the scope of this invention.

What is claimed is:

1. A refrigerator/food warmer picnic box apparatus or the like comprising:

(a) a housing means for forming a food compartment, the housing means having walls forming a top access aperture; and (b) a lid means for closing the housing means aperture, said lid means including walls forming first and second adjacent apertures, a thermal electic unit, and a motor means mounted, respectively, in said first and second lid apertures in sealing engagement with the aperture forming walls, the thermal electric unit having first and second heat sinks mounted on opposing sides of the thermal electric unit with the first heat sink on the food compartment side of the lid and the second heat sink on the exterior side of the lid, and said motor means having a common drive shaft having first and second opposing ends disposed interiorly and exteriorly of the food compartment lid, respectively, and first and second air impellers mounted on the first and second opposing ends of the common drive shaft in operative association with the first and second heat sinks, whereby said first and second air impellers draw air, respectively, through the first and second heat sinks for selectively heating and cooling and circulating the air in the food compartment picnic box, and keeping the second heat sink substantially at ambient temperature.

2. A refrigerator/food warmer apparatus according to claim 1 wherein the housing means includes an insulated housing and a handle operatively connected to the insulated housing whereby said refrigerator/food warmer apparatus is portable.

3. A refrigerator/food warmer picnic box apparatus according to claim 1 wherein said lid means further includes a shroud means operatively connected to the apertured lid for covering the second heat sink and air impeller, said shroud having walls forming an air inlet aperture and vents for venting air entering the shroud.

* * * * *

UNITED STATES PATENT AND TRADEMARK OFFICE

CERTIFICATE OF CORRECTION

PATENT NO. : B1 4,726,193
DATED : July 2, 1996
INVENTOR(S) : Edward J. Burke, et al It is certified that error appears in the above-identified patent and that said Letters Patent is hereby corrected as shown below:

Title page,
Item [19] "Burke et al. " should read -- Burke --; and
Item [75] Inventors: should read -- Edward J. burke, Plano, Texas (US) --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : B1 4,726,193
DATED : July 2, 1996
INVENTOR(S) : Edward J. Burke, et al It is certified that error appears in the above-identified patent and that said Letters Patent is hereby corrected as shown below:

Title page,
Item [19] "Burke et al. " should read -- Burke --; and
Item [75] Inventors: should read -- Edward J. burke, Plano, Texas (US) --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*

US004726193B1

REEXAMINATION CERTIFICATE (2935th)

United States Patent [19]

Burke et al.

[11] B1 4,726,193

[45] Certificate Issued Jul. 2, 1996

[54] TEMPERATURE CONTROLLED PICNIC BOX

[75] Inventors: Edward J. Burke, Plano; Gregory J. Nancarrow, Wylie, both of Tex.

[73] Assignee: Marlow Industries Incorporated, Richardson, Tex.

Reexamination Requests:
No. 90/003,691, Jan. 17, 1995
No. 90/003,833, May 17, 1995

Reexamination Certificate for:

| | |
|---|---|
| Patent No.: | **4,726,193** |
| Issued: | **Feb. 23, 1988** |
| Appl. No.: | **14,360** |
| Filed: | **Feb. 13, 1987** |

[51] Int. Cl.[6] ..... F25B 21/02

[52] U.S. Cl. ..... 62/457.7; 62/449

[56] References Cited

U.S. PATENT DOCUMENTS

| | | | |
|---|---|---|---|
| 3,823,567 | 7/1974 | Corini . | |
| 3,906,741 | 9/1975 | Terry | 62/429 |
| 4,242,874 | 1/1981 | Simms . | |
| 4,326,383 | 4/1982 | Reed et al. . | |

FOREIGN PATENT DOCUMENTS

| | | |
|---|---|---|
| 2432693 | 2/1980 | France . |
| 2501349 | 9/1982 | France . |
| 901767 | 2/1982 | U.S.S.R. . |

*Primary Examiner*—William C. Doerrler
*Attorney, Agent, or Firm*—Jack A. Kanz

[57] ABSTRACT

A refrigerator/food warmer includes an insulated food compartment and lid. A thermoelectric heat exchanger and air circulator are mounted in the lid with both a heatsink of the thermoelectric heat exchanger and an air impeller of the air circulator above and below the lid, respectively. The air impeller above the lid draws air through the corresponding heat sink for improving the temperature differential between opposing sides of the thermoelectric heat exchanger, and the air impeller below the lid forces air of the insulated housing through the corresponding heat sink for conditioning the air hot or cold, as desired, and circulating the conditioned air throughout the insulated housing.

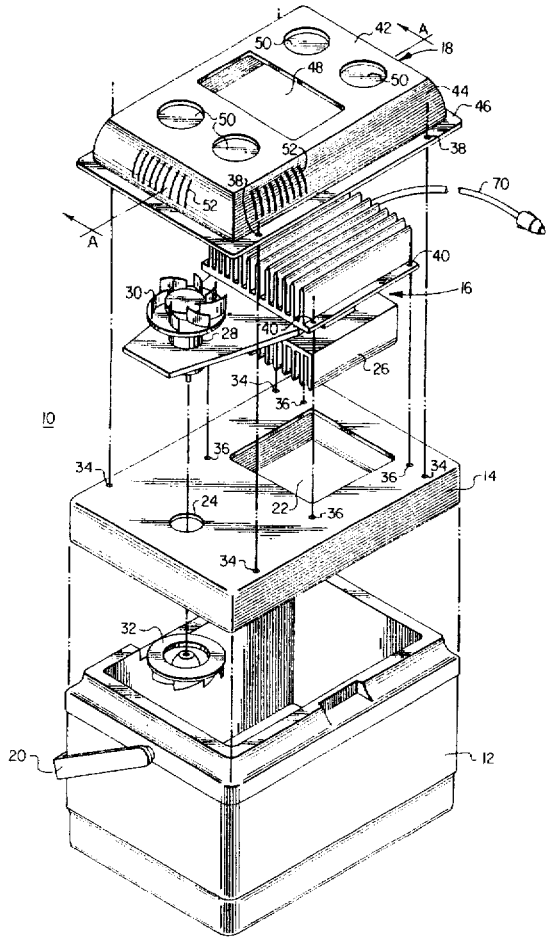

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2 and 3, dependent on an amended claim, are determined to be patentable.

1. A refrigerator/food warmer picnic box apparatus or the like comprising:

(a) a housing means for forming a food compartment, the housing means having walls forming a top access aperture; and (b) a lid means for closing the housing means aperture, said lid means including walls forming first and second adjacent apertures, a thermal electric unit, and a motor means mounted, respectively, in said first and second lid apertures in sealing engagement with the aperture forming walls, the thermal electric unit having first and second *finned plate* heat sinks mounted on opposing sides of the thermal electric unit with the first heat sink on the food compartment side of the lid and the second heat sink on the exterior side of the lid, and said motor means having a common drive shaft having first and second opposing ends disposed interiorly and exteriorly of the food compartment lid, respectively, and first and second air impellers mounted on the first and second opposing ends of the common drive shaft in [operative association] *a planar or parallel planar relationship* with the first and second heat sinks, whereby said first and second air impellers *coact with said finned plate heat sinks to* draw air, respectively, through [the] *spaces formed by the fins of said* first and second heat sinks for selectively heating and cooling and circulating the air in the food compartment picnic box, and keeping the second heat sink substantially at ambient temperature.

* * * * *

US004726193C2

(12) REEXAMINATION CERTIFICATE (4302nd)

United States Patent

Burke et al.

(10) Number: US 4,726,193 C2

(45) Certificate Issued: Mar. 27, 2001

(54) TEMPERATURE CONTROLLED PICNIC BOX

(75) Inventors: Edward J. Burke, Plano; Gregory J. Nancarrow, Wylie, both of TX (US)

(73) Assignee: Marlow Industries, Inc., Dallas, TX (US)

Reexamination Request:
No. 90/005,021, Jun. 22, 1998

Reexamination Certificate for:

| | |
|---|---|
| Patent No.: | **4,726,193** |
| Issued: | **Feb. 23, 1988** |
| Appl. No.: | **07/014,360** |
| Filed: | **Feb. 13, 1987** |

Reexamination Certificate B1 4,726,193 issued Jul. 2, 1996

(51) Int. Cl.[7] ..... F25D 3/08; F25D 19/00

(52) U.S. Cl. ..... 62/457.7; 62/449

(56) References Cited

U.S. PATENT DOCUMENTS 3,823,567 7/1974 Corini ..... 62/3.6

4,326,383 * 4/1982 Reed et al. ..... 62/3.62

FOREIGN PATENT DOCUMENTS 2432693 2/1980 (FR) .

2501349 9/1982 (FR) .

OTHER PUBLICATIONS

ASHRAE 1961 Guide and Data Book: Fundamentals And Equipment.

* cited by examiner

*Primary Examiner*—William C. Doerrler

(57) ABSTRACT

A refrigerator/food warmer includes an insulated food compartment and lid. A thermoelectric heat exchanger and air circulator are mounted in the lid with both a heatsink of the thermoelectric heat exchanger and an air impeller of the air circulator above and below the lid, respectively. The air impeller above the lid draws air through the corresponding heat sink for improving the temperature differential between opposing sides of the thermoelectric heat exchanger, and the air impeller below the lid forces air of the insulated housing through the corresponding heat sink for conditioning the air hot or cold, as desired, and circulating the conditioned air throughout the insulated housing.

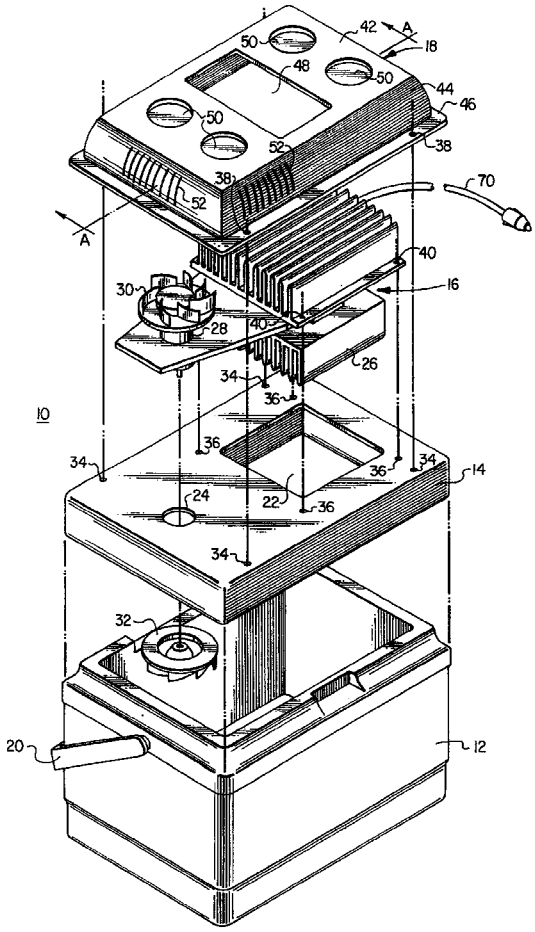

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–3 is confirmed.

New claims 4 and 5 are added and determined to be patentable.

*4. Picnic box apparatus or the like which cools or heats air and circulates cold air or hot air throughout the food compartment comprising:*

(*a*) *a housing means for forming a food compartment, the housing means having walls forming a top access aperture; and*

(*b*) *a lid means for closing the housing means aperture, said lid means including walls forming first and second adjacent apertures, a thermal electric unit, and a motor means mounted, respectively, in said first and second lid apertures in sealing engagement with the aperture forming walls, the thermal electric unit having first and second finned plate heat sinks mounted on opposing sides of the thermal electric unit with the first heat sink on the food compartment side of the lid and the second heat sink on the exterior side of the lid, and said motor means having a common drive shaft having first and second opposing ends disposed interiorly and exteriorly of the food compartment lid, respectively, and first and second air impellers mounted on the first and second opposing ends of the common drive shaft in a planar or parallel planar relationship with the first and second heat sinks, whereby said first and second air impellers coact with said finned plate heat sinks to draw air, respectively, through spaces formed by the fins of said first and second heat sinks for selectively heating and cooling and circulating the air in the food compartment picnic box, and keeping the second heat sink substantially at ambient temperature.*

*5. Picnic box apparatus or the like which cools or heats air and circulates cold air or hot air throughout the food compartment comprising:*

(*a*) *a housing means for forming a food compartment, the housing means having walls forming a top access aperture; and*

(*b*) *a lid means for closing the housing means aperture, said lid means including walls forming first and second adjacent apertures, a thermal electric unit, and a motor means mounted, respectively, in said first and second lid apertures in sealing engagement with the aperture forming walls, the thermal electric unit having first and second finned plate heat sinks mounted on opposing sides of the thermal electric unit with the first heat sink on the food compartment side of the lid and the second heat sink on the exterior side of the lid, and said motor means having a common drive shaft having first and second opposing ends disposed interiorly and exteriorly of the food compartment lid, respectively, and first and second air impellers mounted on the first and second opposing ends of the common drive shaft in a planar or parallel planar relationship with the first and second heat sinks, whereby said first and second air impellers coact with said finned plate heat sinks to draw air, respectively, through spaces formed by the fins of said first and second heat sinks for heating or cooling and circulating the air in the food compartment picnic box, and keeping the second heat sink substantially at ambient temperature.*

* * * * *